US009190733B2

(12) United States Patent
Desclos et al.

(10) Patent No.: US 9,190,733 B2
(45) Date of Patent: Nov. 17, 2015

(54) ANTENNA WITH MULTIPLE COUPLED REGIONS

(71) Applicant: Ethertronics, Inc., San Diego, CA (US)

(72) Inventors: Laurent Desclos, San Diego, CA (US); Chew Chwee Heng, Singapore (SG); Sebastian Rowson, San Diego, CA (US); Jeffrey Shamblin, San Marcos, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 13/767,854

(22) Filed: Feb. 14, 2013

(65) Prior Publication Data

US 2013/0257666 A1 Oct. 3, 2013

Related U.S. Application Data

(63) Continuation of application No. 12/536,419, filed on Aug. 5, 2009, now abandoned, and a continuation-in-part of application No. 13/289,901, filed on Nov. 4, 2011, which is a continuation of application No. 12/894,052, filed on Sep. 29, 2010, now Pat. No. 8,077,116, which is a continuation of application No. 11/841,207, filed on Aug. 20, 2007, now Pat. No. 7,830,320.

(51) Int. Cl.

| | |
|---|---|
| ***H01Q 9/00*** | (2006.01) |
| ***H01Q 9/06*** | (2006.01) |
| ***H01Q 7/00*** | (2006.01) |
| ***H01Q 9/42*** | (2006.01) |
| ***H01Q 19/00*** | (2006.01) |
| ***H01Q 9/16*** | (2006.01) |

(52) U.S. Cl.

CPC ..... *H01Q 9/06* (2013.01); *H01Q 7/005* (2013.01); *H01Q 9/16* (2013.01); *H01Q 9/42* (2013.01); *H01Q 19/005* (2013.01)

(58) Field of Classification Search

CPC ..... H01Q 1/243; H01Q 1/38; H01Q 7/005
USPC ..... 343/702, 747, 846, 745
See application file for complete search history.

(56) References Cited

U.S. PATENT DOCUMENTS

| | | | | |
|---|---|---|---|---|
| 6,339,402 | B1 * | 1/2002 | McKivergan | 343/702 |
| 7,372,406 | B2 * | 5/2008 | Shiotsu et al. | 343/700 MS |
| 7,425,924 | B2 * | 9/2008 | Chung et al. | 343/702 |
| 2004/0233109 | A1 * | 11/2004 | Ying et al. | 343/700 MS |
| 2007/0268190 | A1 * | 11/2007 | Huynh | 343/702 |
| 2009/0051611 | A1 * | 2/2009 | Shamblin et al. | 343/747 |
| 2009/0224991 | A1 * | 9/2009 | Rowson et al. | 343/747 |

* cited by examiner

*Primary Examiner* — Dameon E Levi
*Assistant Examiner* — Hasan Islam
(74) *Attorney, Agent, or Firm* — Coastal Patent Law Group, P.C.

(57) ABSTRACT

An antenna having a driven element coupled to multiple additional elements to resonate at multiple frequencies. A magnetic dipole mode is generated by coupling a driven element to a second element, and additional resonances are generated by coupling additional elements to either or both of the driven or second element. One or multiple active components can be coupled to one or more of the coupled elements to provide dynamic tuning of the coupled or driven elements.

13 Claims, 10 Drawing Sheets

ANTENNA WITH MULTIPLE COUPLED REGIONS

CROSS-REFERENCE TO RELATED APPLICATIONS

This application is a CON of U.S. Ser. No. 12/536,419, filed Aug. 8, 2009, titled "ANTENNA WITH MULTIPLE COUPLED REGIONS"; and a CIP of U.S. Ser. No. 13/289,901, filed Nov. 4, 2011, titled "ANTENNA WITH ACTIVE ELEMENTS"; which is a CON of U.S. Ser. No. 12/894,052, filed Sep. 29, 2010, titled "ANTENNA WITH ACTIVE ELEMENTS"; which is a CON of U.S. Ser. No. 11/841,207, filed Aug. 20, 2007, titled "ANTENNA WITH ACTIVE ELEMENTS";

the contents of each of which are hereby incorporated by reference.

FIELD OF THE INVENTION

This invention relates generally to the field of wireless communication. In particular, the present invention relates to antennas and methods of improving frequency response and selection for use in wireless communications.

BACKGROUND OF THE INVENTION

Commonly owned U.S. Pat. Nos. 6,677,915 filed Feb. 12, 2001, titled "SHIELDED SPIRAL SHEET ANTENNA STRUCTURE AND METHOD"; 6,906,667 filed Feb. 14, 2002, titled "MULTIFREQUENCY MAGNETIC DIPOLE ANTENNA STRUCTURES FOR VERY LOW PROFILE ANTENNA APPLICATIONS"; 6,900,773 filed November 18, 2002, titled "ACTIVE CONFIGUREABLE CAPACITIVELY LOADED MAGNETIC DIPOLE"; and 6,919,857 filed Jan. 27, 2003, titled "DIFFERENTIAL MODE CAPACITIVELY LOADED MAGNETIC DIPOLE ANTENNA"; describe an Isolated Magnetic Dipole (IMD) antenna formed by coupling one element to another in a manner that forms a capacitively loaded inductive loop, setting up a magnetic dipole mode, the entire contents of which are hereby incorporated by reference. This magnetic dipole mode provides a single resonance and forms an antenna that is efficient and well isolated from the surrounding structure. This is, in effect, a self resonant structure that is de-coupled from the local environment.

The overall structure of the IMD antenna can be considered as a capacitively loaded inductive loop. The capacitance is formed by the coupling between the two parallel conductors with the inductive loop formed by connecting the second element to ground. The length of the overlap region between the two conductors along with the separation between conductors is used to adjust the resonant frequency of the antenna. A wider bandwidth can be obtained by increasing the separation between the conductors, with an increase in overlap region used to compensate for the frequency shift that results from the increased separation.

An advantage of this type of antenna structure is the method in which the antenna is fed or excited. The impedance matching section is almost independent from the resonant portion of the antenna. This leaves great flexibility for reduced space integration. The antenna size reduction is obtained in this case by the capacitive loading that is equivalent to using a low loss, high dielectric constant material. At resonance a cylindrical current going back and forth around the loop is formed. This generates a magnetic field along the axis of the loop which is the main mechanism of radiation.

The electrical field remains highly confined between the two elements. This reduces the interaction with surrounding metallic objects and is essential in obtaining high isolation.

The IMD technology is relatively new, and there is a need for improvements over currently available antenna assemblies. For example, because cell phones and other portable communications devices are moving in the direction of providing collateral services, such as GPS, video streaming, radio, and various other applications, the demand for multi-frequency and multi-band antennas is at a steady increase. Other market driven constraints on antenna design include power efficiency, low loss, reduced size and low cost. Therefore, there is a need in the art for antennas which exceed the current market driven requirements and provide multiple resonant frequencies and multiple bandwidths. Additionally, there is a need for improved antennas which are capable of being tuned over a multitude of frequencies. Furthermore, there is a need for improved antennas which are capable of dynamic tuning over a multitude of frequencies in real time.

SUMMARY OF THE INVENTION

This invention solves these and other problems in the art, and provides solutions which include forming additional capacitively loaded inductive loops by adding additional elements that couple to one of the two elements that form the basic IMD antenna. Other solutions provided by the invention include active tuning of multiple coupling regions, switching over a multitude of frequencies, and dynamic tuning of resonant frequencies.

In one embodiment, an antenna is formed by coupling a first element to a second element, and then adding a third element which is coupled to the second element. The first element is driven by a transceiver, with both the second and third elements connected to ground. The additional resonance that is generated is a product of two coupling regions on the composite antenna structure.

In another embodiment, an antenna is formed having a first element driven by a transceiver, and two or more grounded elements coupled to the first element. The space between each of the two or more grounded elements and the first element defines a coupling region, wherein the coupling region forms a single resonant frequency from the combined structure. The resonant frequency is adjusted by the amount of overlap of the two elements. The separation between the two elements determines the bandwidth of the resonance.

In another embodiment, an antenna is formed having a first element driven by a transceiver, a second element connected to ground wherein the second element overlaps with the first element to form a capacitive coupling region, and a third element. The third element can be either driven or grounded and overlaps with at least one of the first element and the second element. Each overlapping region between the first, second and third elements creates a capacitive coupling region forming a resonant frequency, wherein the resonant frequency is adjusted by the amount of overlap and the bandwidth is determined by the separation distance between the overlapping elements. In this embodiment, an overlapping region can be formed between the driven element and a grounded element, or alternatively the overlapping region can be formed between two grounded elements.

In another embodiment, the grounded elements are parallel to the driven element. Alternatively, the grounded elements can be orthogonal with respect to the driven element. One or more elements can comprise an active tuning component. The active tuning component can be configured within or near a ground plane. Alternatively, one or more active components can be configured on an antenna element. One or more antenna elements can be bent. One or more antenna elements can be linear, or planar. One or more antenna elements can be fixedly disposed above a ground plane. Alternatively, one or more antenna elements can be configured within a ground plane.

In another embodiment, an antenna is provided having a high band radiating element and a low band radiating element. A switched network can be integrated with at least one of the high band or low band radiating elements.

DETAILED DESCRIPTION OF THE PREFERRED EMBODIMENTS

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

Embodiments of the present invention provide an active tuned loop-coupled antenna capable of optimizing an antenna over incremental bandwidths and capable of tuning over a large total bandwidth. The active loop element is capable of serving as the radiating element or an additional radiating element may also be coupled to this active loop. In various embodiments, multiple active tuned loops can be coupled together in order to extend the total bandwidth of the antenna. Such active components may be incorporated into the antenna structure to provide further extensions of the bandwidth along with increased optimization of antenna performance over the frequency range of the antenna.

Figure 1:
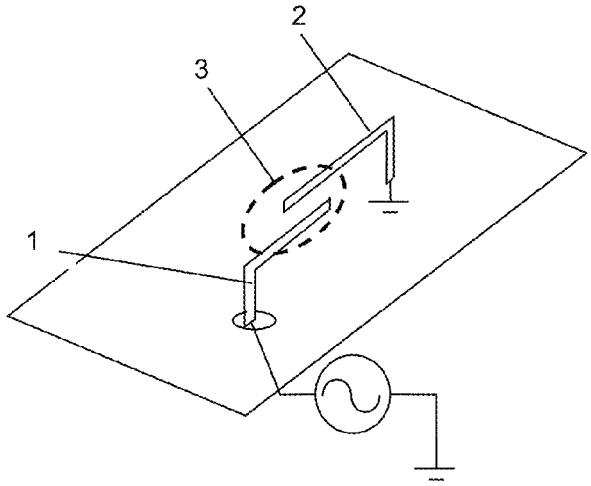
FIG. 1 illustrates an exemplary isolated magnetic dipole (IMD) antenna comprised of a first element attached to a transmitter and coupled to a second element which is connected to ground.

FIG. 1 illustrates a driven element 1, and a capacitively coupled element 2 that is grounded forming an inductive loop. The coupling region 3 between elements 1 and 2 forms a single resonant frequency from the combined structure. The resonant frequency is adjusted by the amount of overlap of the two elements. The separation between the two elements determines the bandwidth of the resonance.

Figure 2:
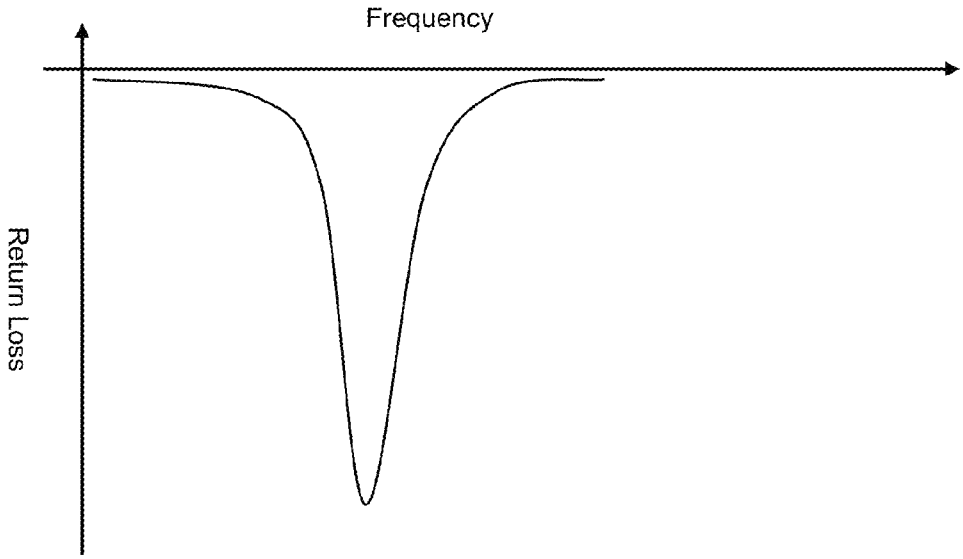
FIG. 2 shows a plot of return loss as a function of frequency for the IMD antenna in FIG. 1. A single resonance is present.

FIG. 2 illustrates a plot of frequency vs. return loss showing the effect of coupling a driven element and one capacitively coupled element that is grounded. A single resonant frequency is shown.

Figure 3:
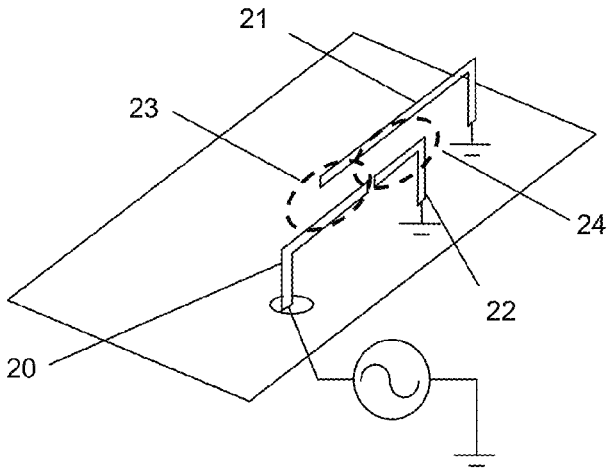
FIG. 3 illustrates an isolated magnetic dipole (IMD) antenna comprised of a first element attached to a transmitter and coupled to a second element which is connected to ground along with a third element which is coupled to the second element.

FIG. 3 illustrates a driven element 20, and two capacitively coupled elements 21 and 22 that are grounded forming inductive loops. The coupling 23 between elements 20 and 21, and the coupling 24 between 21 and 22 produces two resonant frequencies each determined by the amount of overlap and separation between the two elements. The separation between the elements determines the bandwidth for each resonance.

Figure 4:
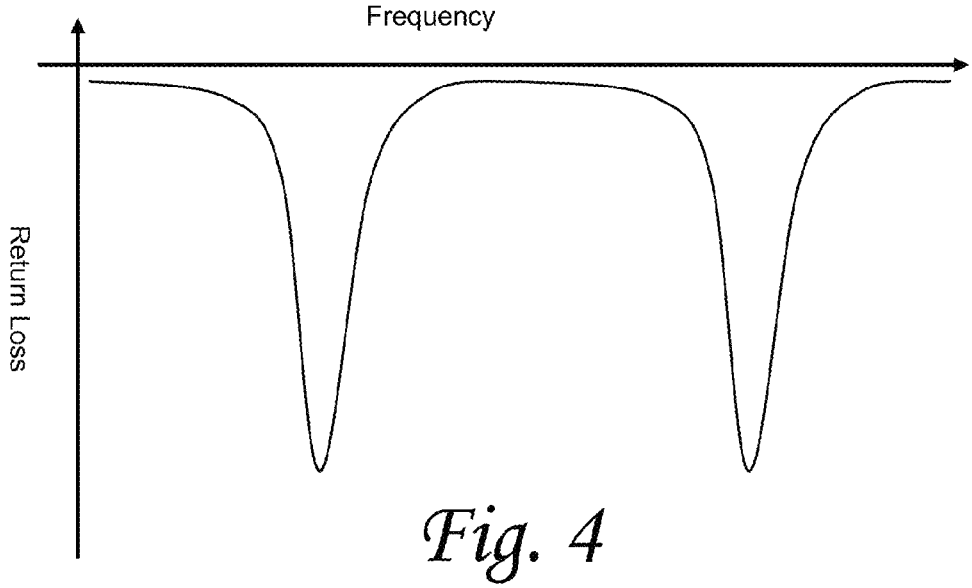
FIG. 4 shows the return loss as a function of frequency for the antenna shown in FIG. 3. A second resonance is present which is formed by the addition of the third element.

FIG. 4 illustrates a plot of frequency vs. return loss showing the effect of coupling a driven element and two capacitively coupled elements. Two resonate frequencies are shown.

Figure 5:
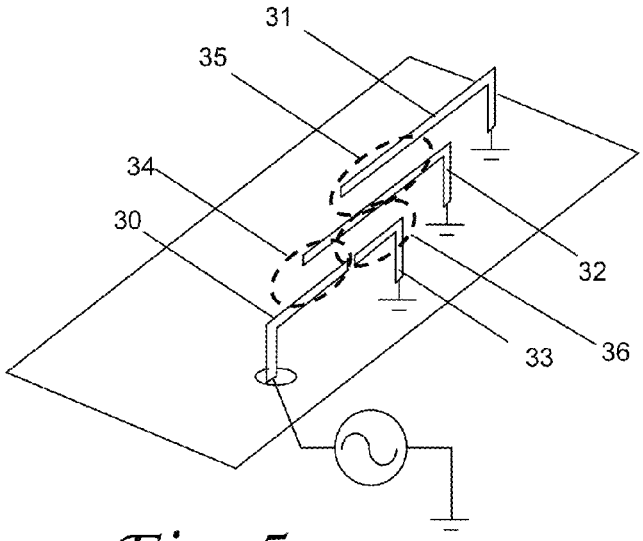
FIG. 5 illustrates an IMD antenna with two additional elements, a third and fourth, each coupled to the second element of the IMD antenna.

FIG. 5 illustrates a driven element 30, and three capacitively coupled elements 31, 32 and 33 that are grounded forming inductive loops. The coupling 34 between elements 30 and 32, the coupling 35 between 31 and 32 and coupling 36 between 32 and 33 produces three resonant frequencies each determined by the amount of overlap and separation between the three elements. The separation between the elements determines the bandwidth for each resonance.

Figure 6:
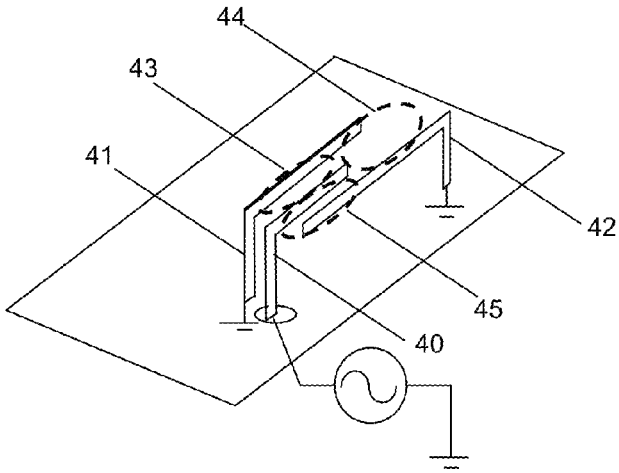
FIG. 6 illustrates an isolated magnetic dipole (IMD) antenna comprised of an element attached to a transmitter and coupled to a second element which is connected to ground along with a third element which is coupled to the first element.

FIG. 6 illustrates a driven element 40, and two capacitively coupled elements 41 and 42 that are grounded forming inductive loops. The positioning of the elements creates an overlapping between the elements that forms three couplings 43, 44 and 45. The separation between the elements determines the bandwidth for each resonance.

Figure 7:
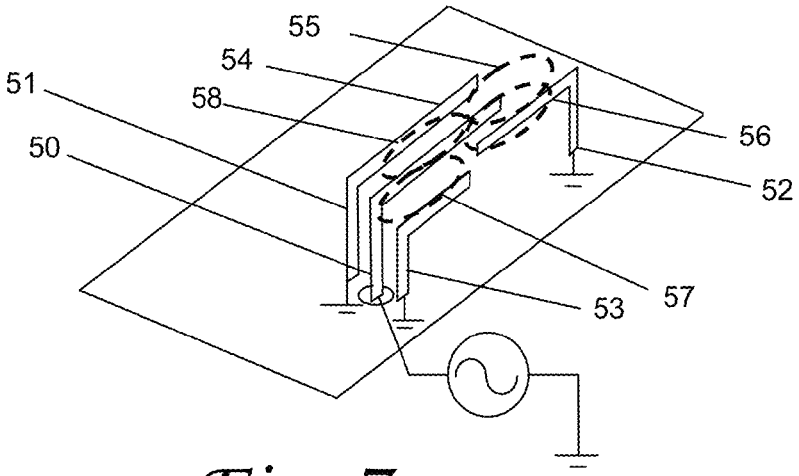
FIG. 7 illustrates an IMD antenna with two additional elements, a third and fourth, each coupled to the first element of the IMD antenna.

FIG. 7 illustrates a driven element 50, and four capacitively coupled elements 51, 52, 53 and 54 that are grounded forming inductive loops. The positioning of the elements creates an overlapping between the elements that forms four couplings 55, 56, 57 and 58. The separation between the elements determines the bandwidth for each resonance.

Figure 8:
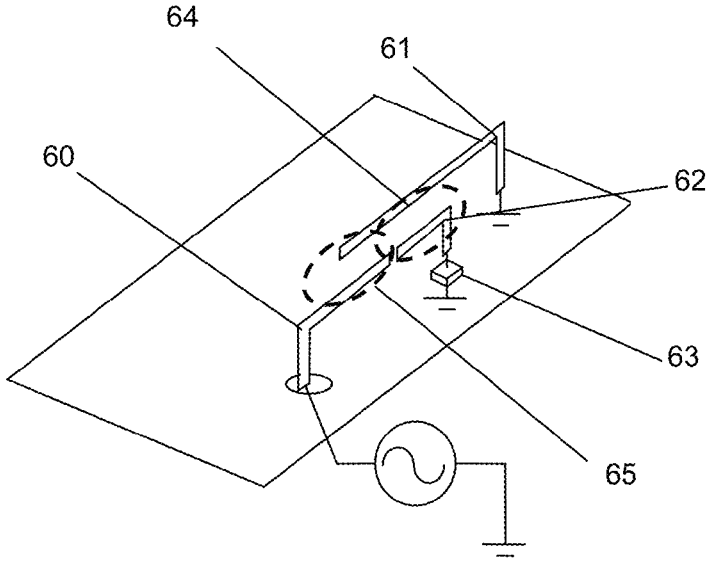
FIG. 8 illustrates an isolated magnetic dipole (IMD) antenna comprised of a first element attached to a transmitter and coupled to a second element which is connected to ground along with a third element which is coupled to the second element. A component is connected between the third element and ground.

FIG. 8 illustrates a driven element 60 having a vertical portion thereof extending from a circuit board to a vertical terminus, and further having a horizontal portion extending from the vertical terminus to a horizontal terminus, with a first passive element 61 positioned adjacent to the driven element. At least a portion of the first passive element is configured to overlap with a at least a part of the horizontal portion of the driven element. The first passive element is connected to ground forming an inductive loop and further forming a coupling region 65 between the first passive element and the horizontal portion of the driven element. The frequency response generated by this coupling region 65 will be dependent upon the amount of overlap and separation distance of the elements 60 and 61. A second coupled element 62 is connected to ground via a component 63. If this component is passive (inductor, capacitor, resistor) it will create a fixed frequency response from the coupling region 64. If the component is tunable (tunable capacitor, varactor diode, etc.) then the frequency response can be dynamically tuned (in real time). The inductive loop including a current flow through the vertical portion and the horizontal portion of the driven element 60, wherein the current flow is bifurcated with a first portion of the current continuing through the first passive element 61 and a second portion of the current flowing through the active coupling element 62. Although not illustrated, those with skill in the art will appreciate the current flow based solely on the arrangement of the driven element, passive and active coupling elements and respective ground reference indicators.

Figure 9:
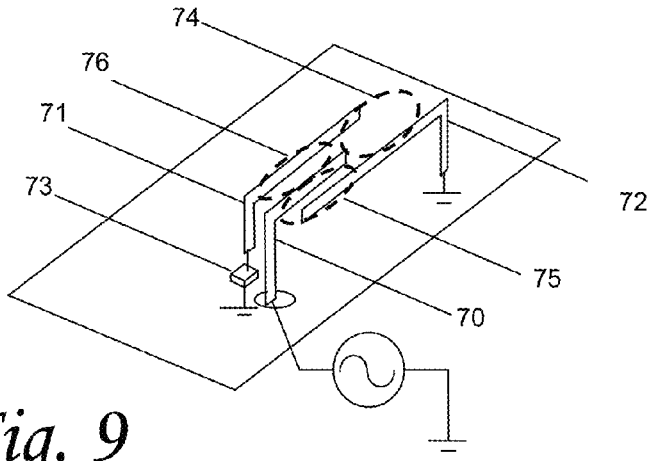
FIG. 9 illustrates an isolated magnetic dipole (IMD) antenna comprised of a first element attached to a transmitter and coupled to a second element which is connected to ground along with a third element which is coupled to the first element. A component is connected between the third element and ground.

FIG. 9 illustrates a driven element 70 with one capacitively coupled element 72 that is connected to ground forming an inductive loop and a coupling region 75. The frequency of this coupling region 75 will be dependent upon the amount of overlap and separation distance of the elements 70 and 72. The driven element 70 is also coupled to a second element 71 that is connected to ground via a component 73. If this component is passive (inductor, capacitor, resistor) it will create a fixed frequency response from the coupling region 76. If the component is tunable (tunable capacitor, varactor diode, etc.) then the frequency response can be dynamically tuned (in real time). Element 71 is also coupled to element 72 and will have a fixed or dynamically tuned frequency response, dependent on the type and value of component 73.

Figure 10:
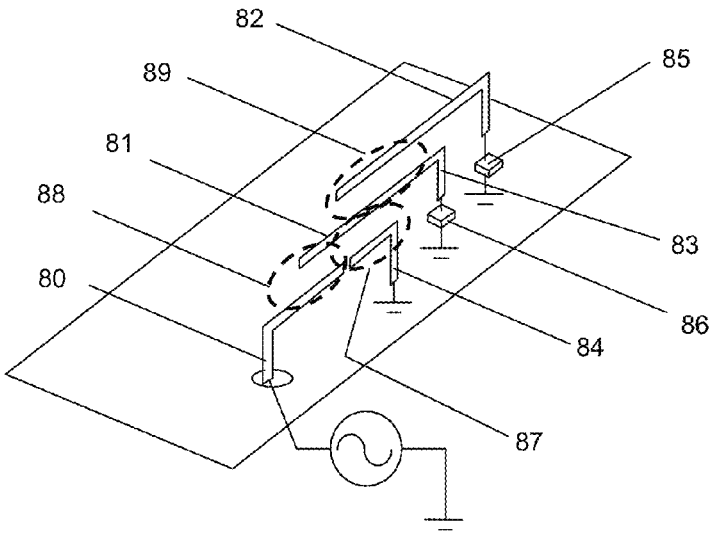
FIG. 10 illustrates an IMD antenna with two additional elements, a third and fourth, each coupled to the second element of the IMD antenna. A component is connected between the third element and ground, with another component connected between the second element and ground.

FIG. 10 illustrates a driven element 80 coupled to a second element 81 that is connected to ground via a component 86. If this component is passive (inductor, capacitor, resistor) it will create a fixed frequency response from the coupling region 76. If the component is tunable (tunable capacitor, varactor diode, etc.) then the frequency response can be dynamically tuned (in real time). Element 81 forms a coupling 87 with element 84 that is connected to ground. The frequency of this coupling region 87 will be dependent upon the amount of overlap and separation distance of the elements 81, 84 and the driven element 80. Another coupling region 89 is formed by elements 81 and 82. Both elements are connected to ground by components 85 and 86.

Figure 11:
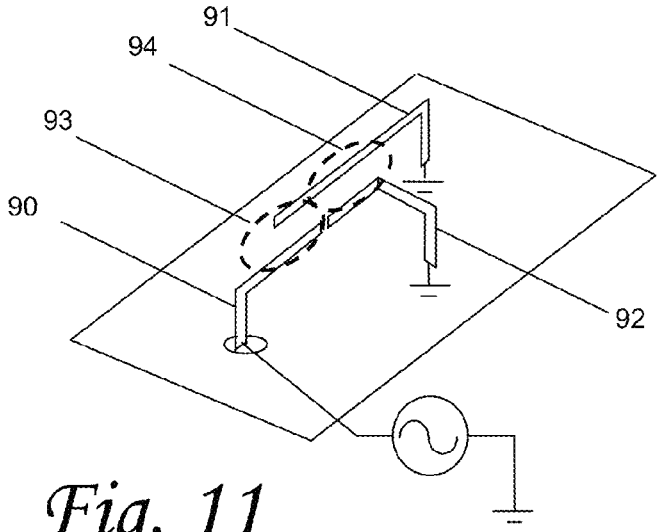
FIG. 11 illustrates an IMD antenna with an additional element coupled to the second element of the IMD antenna. The additional element is configured in a 3-dimensional shape and is not restricted to a plane containing the first two elements.

FIG. 11 illustrates a driven element 90 with one capacitively coupled element 91 that is connected to ground forming an inductive loop and a coupling region 93. An additional coupling is formed between capacitively coupled elements 91 and 92. The frequency of this coupling region 94 will be dependent upon the amount of overlap and separation distance of the elements 91 and 92 and driven element 90.

Figure 12:
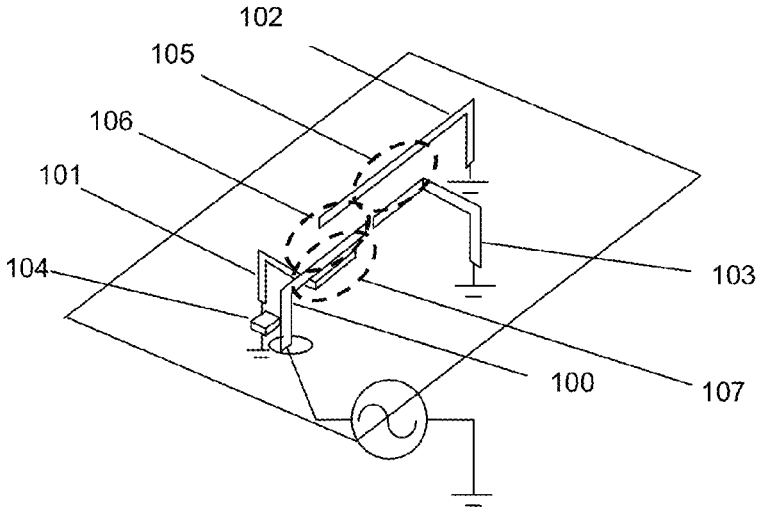
FIG. 12 illustrates an IMD antenna with two additional elements, a third and fourth, with the third element coupled to the second element and the fourth element coupled to the first element. Both the third and fourth elements are bent in 3 dimensional shapes and are not restricted to a plane containing the first two elements. A component is connected between the fourth element and ground.

FIG. 12 illustrates a driven element 100 with a capacitively coupled element 102 that is connected to ground forming an inductive loop and coupling region 106. Element 102 is capacitively coupled to element 103 that is connected to ground forming an inductive loop and coupling region 105. Element 103 is bent in a 3 dimensional shape and is not restricted to a plane containing the other elements. The driven element 100 is also coupled to a second element 101 that is connected to ground via a component 104 forming a coupling region 107 with driven element 100. If the component 104 is tunable (tunable capacitor, varactor diode, etc.) then the frequency response can be dynamically tuned (in real time). Element 101 is bent in a 3 dimensional shape and is not restricted to a plane containing the other elements.

Figure 13:
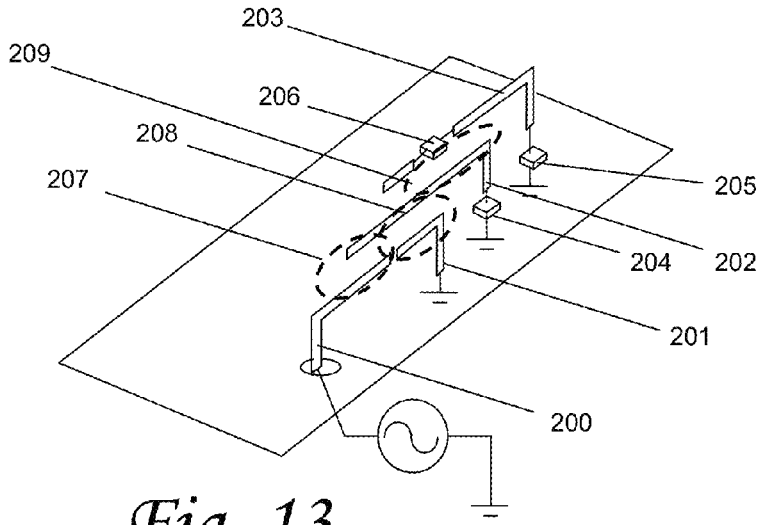
FIG. 13 illustrates an IMD antenna with two additional elements, a third and fourth, with a component connecting two portions of the third element.

FIG. 13 illustrates a driven element 200 in-line with element 201 that is connected to ground. The driven element 200 is coupled to a second element 202 that is connected to ground via a component 204 forming a coupling region 207 with driven element 200. If the component 204 is tunable (tunable capacitor, varactor diode, etc.) then the frequency response can be dynamically tuned (in real time). Element 202 also forms a coupling 209 with element 203 that is grounded via a component 205. In addition element 203 has a component 206 that connects the two parts of element 203 further extending frequency tuning and response.

Figure 14:
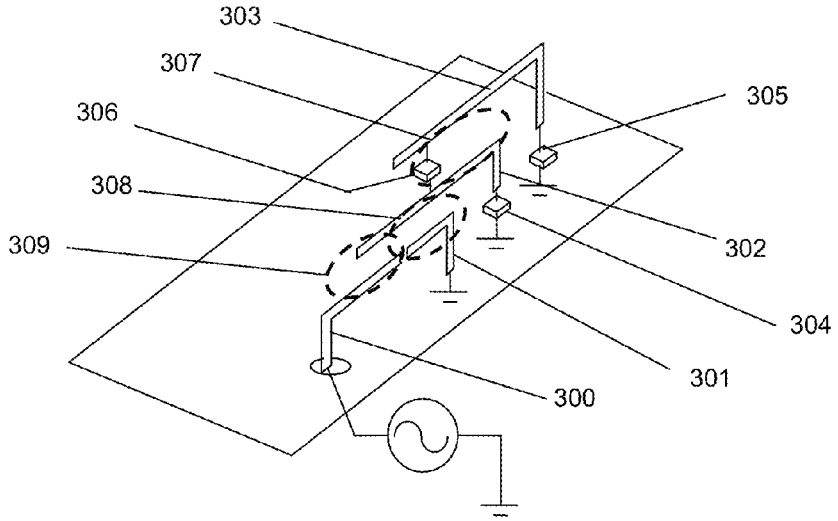
FIG. 14 illustrates an IMD antenna with two additional elements, a third and fourth, with a component connecting the third and fourth elements.

FIG. 14 illustrates a driven element 300 in-line with element 301 that is connected to ground. The driven element 300 is coupled to a second element 302 that is connected to ground via a component 304 forming a coupling region 309 with driven element 300. If the component 304 is tunable (tunable capacitor, varactor diode, etc.) then the frequency response can be dynamically tuned (in real time). Element 302 also forms a coupling 308 with element 301 that is is connected to ground forming an inductive loop. A further coupling is formed between element 302 and element. A component 306 is connected to elements 302 and 303, providing additional tuning of the frequency response.

Figure 15:
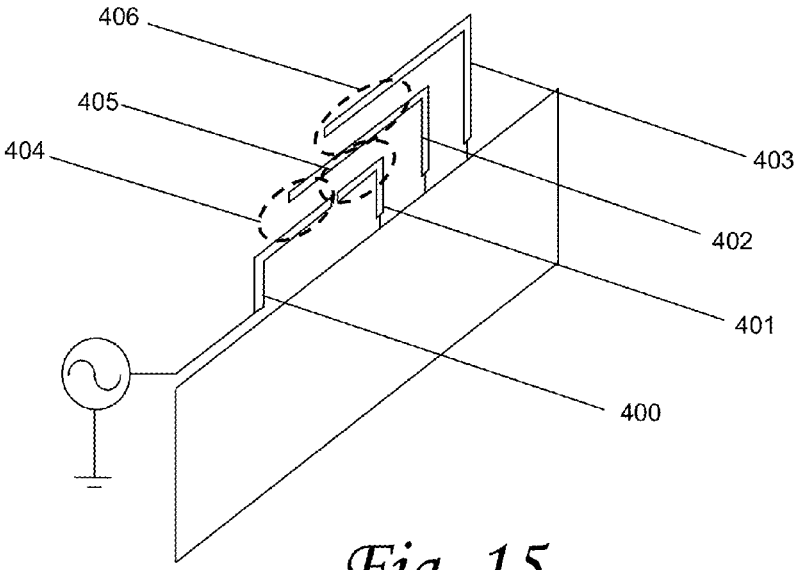
FIG. 15 illustrates an IMD antenna with two additional elements, a third and fourth, with all four elements positioned in the plane of the ground plane.

FIG. 15 FIG. 12 illustrates a driven element 400 with capacitively coupled elements 401, 402 and 403 that are connected to the edge of a ground plane producing three couplings 404, 405 and 406 respectively.

Figure 16:
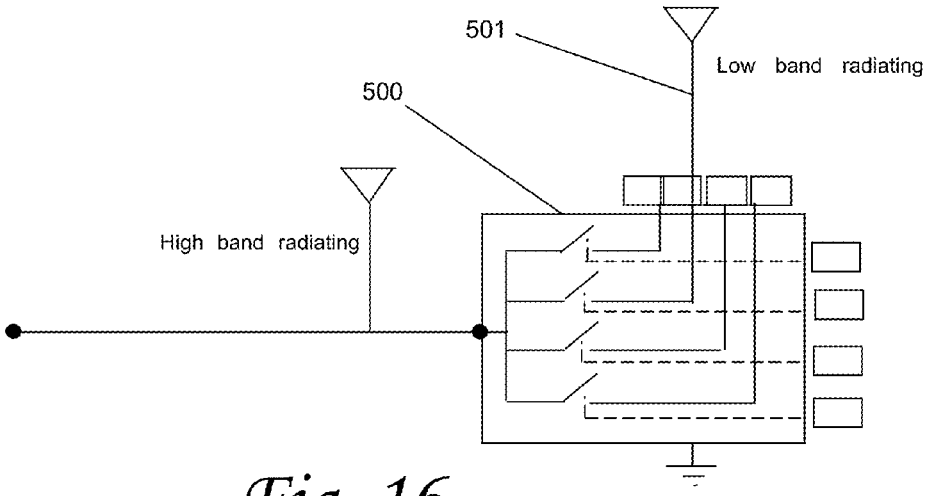
FIG. 16 illustrates an antenna configuration where a switch network is integrated into the low band radiating element to provide a tunable antenna. The switch network can be implemented in a MEMS process, integrated circuit, or discrete components.

FIG. 16 illustrates an antenna configuration where a switch network 500 is integrated into the low band radiating element 501 to provide a tunable antenna. The switch network can be implemented in a MEMS process, integrated circuit, or discrete components.

Figure 17:
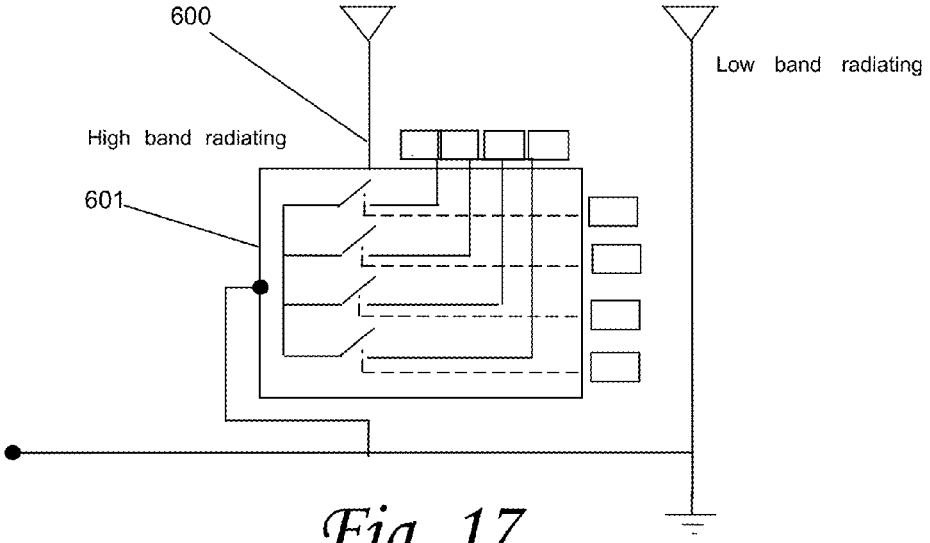
FIG. 17 illustrates an antenna configuration where a switch network is integrated into the high band radiating element to provide a tunable antenna. The switch network can be implemented in a MEMS process, integrated circuit, or discrete components.

FIG. 17 illustrates an antenna configuration where a switch network is integrated into the high band 600 radiating element to provide a tunable antenna. The switch network 601 can be implemented in a MEMS process, integrated circuit, or discrete components.

Figure 18:
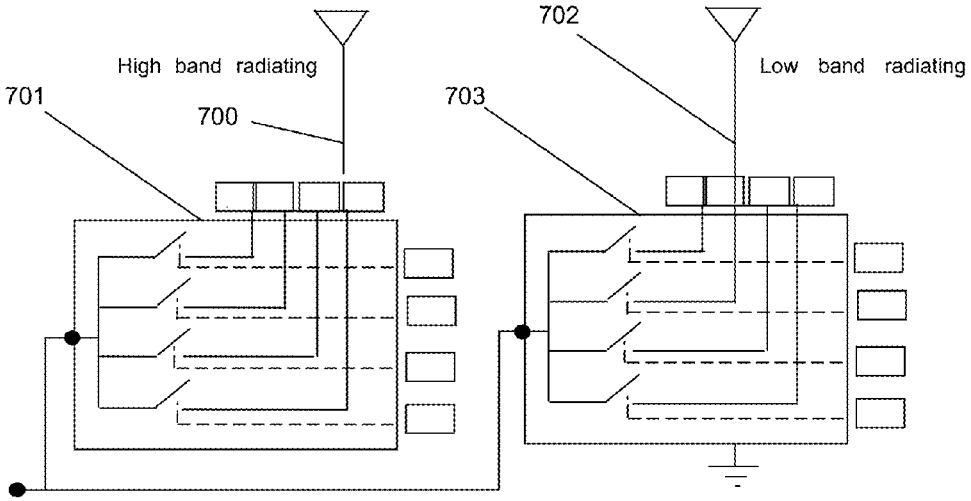
FIG. 18 illustrates an antenna configuration where switch networks are integrated into the low band and high band radiating elements to provide a tunable antenna. The switch networks can be implemented in a MEMS process, integrated circuit, or discrete components.

FIG. 18 illustrates an antenna configuration where switch networks are integrated into the low band 700 and high band 702 radiating elements to provide a tunable antenna. The switch networks 701 and 703 can be implemented in a MEMS process, integrated circuit, or discrete components.

Figure 19:
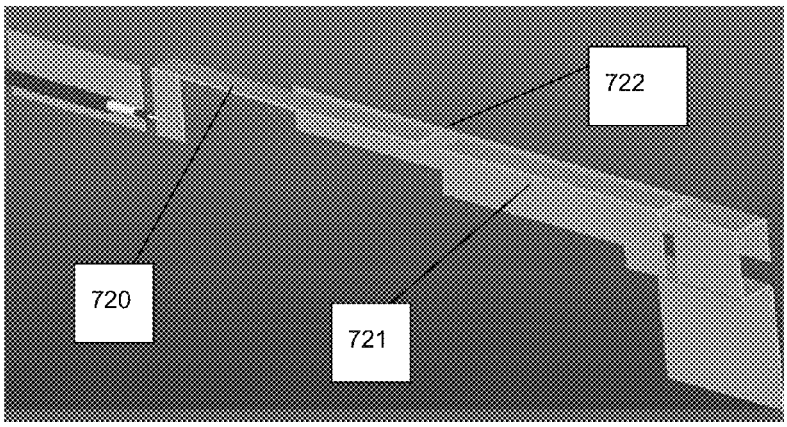
FIG. 19 illustrates an antenna implementation of the concept described in FIG. 3. A driven element is coupled to two additional elements, resulting in a low band and high band resonance.

FIG. 19 illustrates antenna implementation of the concept described in FIG. 3. A driven element 720 is coupled to two additional elements, 721 and 722, resulting in a low band and high band resonance.

Figure 20:
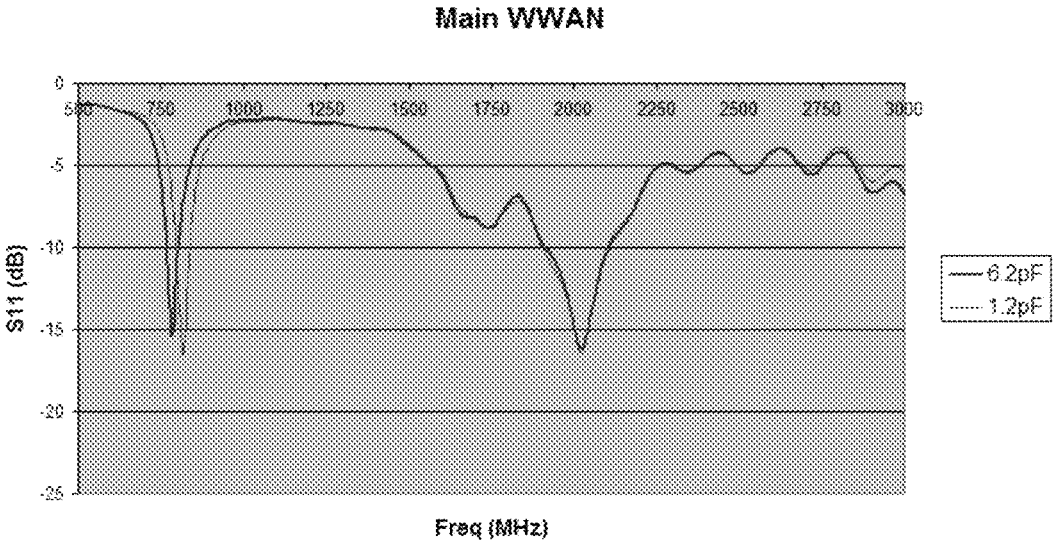
FIG. 20 shows the return loss of the antenna configuration shown in FIG. 19. The two traces refer to two capacitor values for component loadings of the second element. The capacitor is not shown in FIG. 19.

FIG. 20 illustrates a plot of frequency vs. return loss for the antenna described in FIG. 19. The two traces refer to two capacitor values for a component loading element 721.

In an embodiment, the antenna can comprise:

a driven element positioned above a circuit board, the driven element being coupled to a transceiver at a feed;

a first passive element positioned above the circuit board and adjacent to the driven element, the first passive element and the driven element configured to form a first coupling region therebetween, wherein the first passive element and the driven element are capacitively coupled at the first coupling region; and an active coupling element comprising a conductor being positioned near at least one of the driven element and the first passive element to form one or more active coupling regions, the active coupling element being coupled to an active tuning component for varying a tunable reactance thereof for adjusting a resonance of the active coupling regions.

In some embodiments, the antenna is configured to provide a first static frequency response associated with the first coupling region and a distinct dynamic frequency response associated with each of the one or more active coupling regions.

In some embodiments, the first passive element is coupled to a passive component selected from a capacitor, resistor, and an inductor.

In some embodiments, the active tuning component is selected from a variable capacitor, a variable inductor, a MEMS device, MOSFET, or a switch.

In some embodiments, the antenna comprises two or more passive elements.

In some embodiments, the antenna comprises two or more active coupling elements.

What is claimed is:

1. An antenna having multiple coupled regions, comprising:

a driven element positioned above a circuit board, the driven element having a vertical conductor portion extending vertically from a circuit board to a vertical terminus and a horizontal conductor portion extending horizontally from the vertical terminus to a horizontal terminus, wherein the driven element is configured to couple with a transceiver;

a first passive element positioned above the circuit board and adjacent to the driven element, the first passive element and the horizontal conductor portion of the driven element configured to form a first coupling region therebetween, wherein the first passive element and the driven element are capacitively coupled at the first coupling region; and an active coupling element comprising a conductor being positioned adjacent to the first passive element, the active coupling element and the first passive element forming an active coupling region therebetween, the active coupling element being coupled to an active tuning component for varying a tunable reactance thereof for adjusting a resonance of the active coupling region;

wherein the antenna is configured to simultaneously provide each of:

a first static frequency response associated with the first coupling region, and a distinct dynamic frequency response associated with the active coupling region.

2. The antenna of claim 1, wherein the first passive element is coupled to a passive component selected from a capacitor, resistor, and an inductor.

3. The antenna of claim 1, wherein the active tuning component is selected from a variable capacitor, a variable inductor, a MEMS device, MOSFET, or a switch.

4. The antenna of claim 1, comprising two or more passive elements.

5. The antenna of claim 1, comprising two or more active coupling elements.

6. The antenna of claim 1, wherein at least a portion of said first passive element is disposed between said driven element and said circuit board.

7. The antenna of claim 5, wherein at least a portion of one of said active coupling elements is disposed between said driven element and said circuit board.

8. The antenna of claim 5, further comprising a switch, wherein each of said two or more active coupling elements is coupled to said switch to form a switch network; wherein the antenna is configured to select among the two or more active coupling elements for configuring multiple active resonances of the antenna.

9. The antenna of claim 1, wherein the horizontal conductor portion of the driven element is configured to couple with each of the first passive element and the active coupling element; the first passive element being configured to couple with the horizontal conductor portion of the driven element to form a first coupling region therebetween, and wherein said active coupling element is configured to couple with the horizontal conductor portion of the driven element to form an active coupling region therebetween.

10. The antenna of claim 5, wherein each of said active coupling elements is further coupled to an active tuning component for providing a plurality of configurable resonances.

11. The antenna of claim 1, wherein the antenna is configured to form each of:

a first static coupling region disposed between the first passive element and the horizontal conductor portion of the driven element;

a first active coupling region disposed between the first passive element and the active coupling element; and a second active coupling region disposed between the horizontal conductor portion of the driven element and the active coupling element.

12. The antenna of claim 1, wherein the antenna is configured to form a current loop, the current loop extending along the vertical conductor portion and the horizontal conductor portion, the current loop being bifurcated at the horizontal terminus with at least a first portion thereof continuing through the first passive element and at least a second portion thereof continuing through the second passive element.

13. An antenna having multiple coupled regions, comprising:

a driven element positioned above a circuit board, the driven element having a vertical conductor portion extending vertically from a circuit board to a vertical terminus and a horizontal conductor portion extending horizontally from the vertical terminus to a horizontal terminus;

a first passive element positioned above the circuit board and adjacent to the driven element, the first passive element and the horizontal conductor portion of the driven element configured to form a first coupling region therebetween, wherein the first passive element and the driven element are capacitively coupled at the first coupling region; and an active coupling element comprising a conductor being positioned adjacent to the driven element, the active coupling element and the driven element forming an active coupling region therebetween, the active coupling element being coupled to an active tuning component for varying a tunable reactance thereof for adjusting a resonance of the active coupling region;

wherein the antenna is configured to simultaneously provide each of:

a first static frequency response associated with the first coupling region, and a dynamic frequency response associated with the active coupling region.

* * * * *